US009555661B2

(12) United States Patent
Cheng et al.

(10) Patent No.: US 9,555,661 B2
(45) Date of Patent: Jan. 31, 2017

(54) ELECTRIC PENCIL SHARPENER WITH A REPLACEABLE CUTTER ASSEMBLY

(75) Inventors: Che-Chang Cheng, Chang Hua (TW); Chien-Hsing Chang, Chang Hua (TW); Liang-Liang Yao, Chang Hua (TW)

(73) Assignee: SDI CORPORATION (TW)

( * ) Notice: Subject to any disclaimer, the term of this patent is extended or adjusted under 35 U.S.C. 154(b) by 1197 days.

(21) Appl. No.: 13/592,338

(22) Filed: Aug. 23, 2012

(65) Prior Publication Data

US 2013/0186517 A1 Jul. 25, 2013

(30) Foreign Application Priority Data

Jan. 20, 2012 (TW) ..... 101102481 A

(51) Int. Cl.
*B43L 23/02* (2006.01)
*B43L 23/08* (2006.01)

(52) U.S. Cl.
CPC ..... *B43L 23/02* (2013.01); *B43L 23/08* (2013.01)

(58) Field of Classification Search
CPC ..... B43L 23/00; B43L 23/008; B43L 23/004; B43L 23/08; B43L 23/06; B43L 23/085; B43L 23/04; B43L 23/02
See application file for complete search history.

(56) References Cited

U.S. PATENT DOCUMENTS 5,875,555 A * 3/1999 Andrisin, III ..... B43L 23/08 144/28.5
6,845,795 B2 * 1/2005 Lammers ..... B43L 23/02 144/28.5
8,205,648 B2 * 6/2012 Hsu ..... B43L 23/008 144/28.1
2010/0175788 A1 * 7/2010 Yeh ..... B43L 23/06 144/28.72

* cited by examiner

*Primary Examiner* — Matthew G Katcoff
(74) *Attorney, Agent, or Firm* — Hershkovitz & Associates, PLLC; Abe Hershkovitz

(57) ABSTRACT

An electric pencil sharpener has a body, a cover and a cutter assembly. The body has a transmission device and a waste case having an opening. The cover is mounted on and closes the opening of the waste case. The cutter assembly is mounted in the waste case, is detachable from the waste case via the opening and has a connection base, a cutter bracket and a cutter. The connection base has a combining hole defined through the connection base. The cutter bracket is connected rotatably with the connection base and has a connection element connected with transmission device to make the cutter bracket driven by and rotate with the transmission device. The cutter is mounted on the cutter bracket. Accordingly, the cutter assembly is easily and conveniently replaceable when the cutter of the cutter assembly is damaged or worn off.

16 Claims, 11 Drawing Sheets

ELECTRIC PENCIL SHARPENER WITH A REPLACEABLE CUTTER ASSEMBLY

BACKGROUND OF THE INVENTION

1 . Field of the Invention

The present invention relates to a pencil sharpener, and more particularly to an electric pencil sharpener with a replaceable cutter assembly.

2 . Description of Related Art

An electrical pencil sharpener can sharpen a pencil with a motor-driven cutter and is more convenient than a manually operated pencil sharpener. However, the cutter of the conventional electrical pencil sharpener is connected directly with a transmission device for being connected to and driven by a driving device, so the cutter is difficult and even impossible to be detached from the driving device by a user. When the unchangeable cutter is damaged, the whole pencil sharpener has to be thrown away, and this causes waste of money and usable components in the pencil sharpener.

Some electrical pencil sharpeners, upon purchase, are provided with extra cutters for future replacement. However, when replacing the cutter, the user not only has to disassemble the electrical pencil sharpener, but also has to demount the worn cutter from the pencil sharpener and then mount a new cutter onto the pencil sharpener by a screw driver or any other tool. The mounting and demounting of the cutter are both troublesome and time-consuming, causing huge inconvenience to the user.

To overcome the shortcomings, the present invention tends to provide an electric pencil sharpener with a replaceable cutter assembly to mitigate or obviate the aforementioned problems.

SUMMARY OF THE INVENTION

The main objective of the invention is to provide an electric pencil sharpener having a replaceable cutter assembly to easily and conveniently replace a worn-off cutter assembly with a new one, such that the practicality of the electric pencil sharpener is improved and the cost for replacing the cutter assembly is lowered.

The electric pencil sharpener has a body, a cover and a cutter assembly. The body has a transmission device and a waste case. The transmission device is mounted in the body. The waste case is mounted on the body and has an opening defined in a top of the waste case. The cover is mounted on and closes the opening of the waste case and has a pencil inserting hole defined through the cover and at least one connection recess defined in the cover. The cutter assembly is mounted in the waste case, is detachable from the waste case via the opening and has a connection base, a cutter bracket and a cutter. The connection base is connected detachably with the cover with a male and female connection structure and has a combining hole defined through the connection base and corresponding to the pencil inserting hole. The connection base further has at least one connection tab formed on and protruding from the connection base, and the at least one connection recess respectively engages the at least one connection tab on the connection base. The cutter bracket is connected rotatably with the connection base and has a connection element disposed on the cutter bracket at an end opposite to the connection base and connected with the transmission device to make the cutter bracket driven by and rotate with the transmission device. The cutter is mounted on the cutter bracket.

Accordingly, when the cutter is worn off or damaged, the cutter assembly can be detached from the cover or the bottom of the waste case directly after the cover is removed from the waste case. A new cutter assembly can be easily connected with the cover or the bottom of the waste case, so to replace the cutter assembly is easy and convenient. It is unnecessary to throw a whole electric pencil sharpener away, so that waste of resources is reduced and the cost for using the electric pencil sharpener is also greatly lowered.

Other objects, advantages and novel features of the invention will become more apparent from the following detailed description when taken in conjunction with the accompanying drawings.

DETAILED DESCRIPTION OF PREFERRED EMBODIMENT

Figure 1:
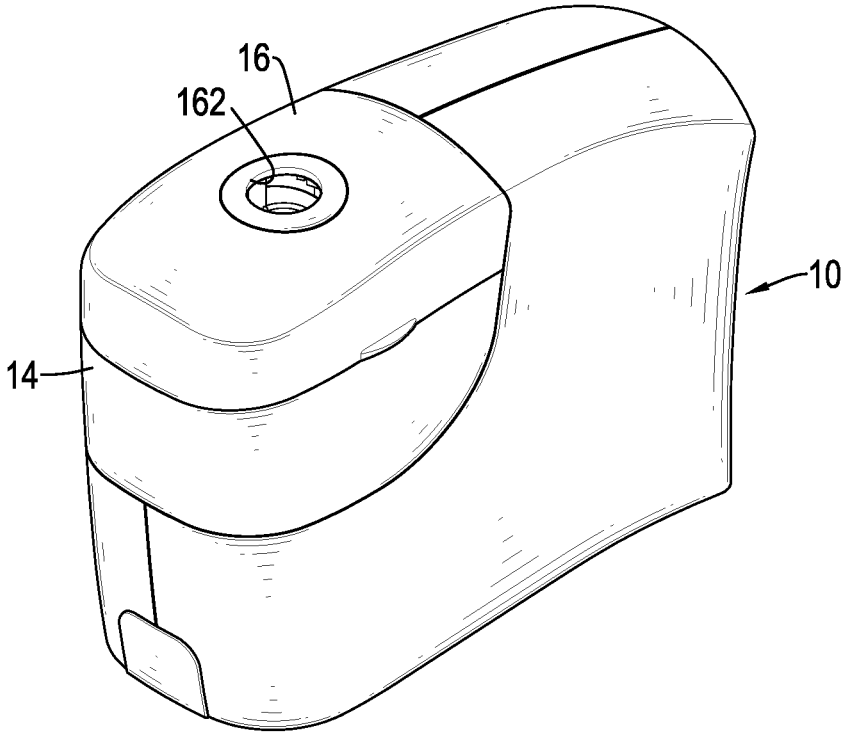
FIG. 1 is a perspective view of a first embodiment of a pencil sharpener in accordance with the present invention.

With reference to FIGS. 1 to 4, an electric pencil sharpener in accordance with the present invention comprises a body 10, a transmission device 12, a waste case 14, a cover 16 and a cutter assembly 20.

The transmission device 12 is mounted in the body 10, comprises a motor, a power supply and a gear set and may be conventional, so the detail description of the transmission device 12 is omitted. The transmission device 12 has a transmission element 122 mounted inside the waste case 14.

The waste case 14 is mounted securely or detachably on the body 10 and has an opening defined in the top of the waste case 14. The cover 16 is mounted on and closes the opening of the waste case 14 and has a pencil inserting hole 162 formed through the cover 16.

With reference to FIGS. 2 to 5, the cutter assembly 20 is mounted in the waste case 14, is detachable from the waste case 14 via the opening and is connected to and driven by the transmission device 12. In the first embodiment, the cutter assembly 20 is connected detachably to the cover 16 with a male and female connection structure. The cutter assembly 20 comprises a connection base 22, a cutter bracket 24 and a cutter 26. The connection base 22 is connected detachably with the cover 16 and comprises at least one connection tab 222 formed on and protruding from the connection base 22. The cover 16 has at least one connection recess 164 defined in the cover 16 and respectively engaging the at least one connection tab 222 on the connection base 22. Preferably, two connection tabs 222 and two connection recesses 164 are implemented. With the engagement between the connection tabs 222 and the connection recesses 164, the connection base 22 is connected detachably with the cover 16. Alternatively, the connection tabs 222 can be formed on the cover 16, and the connection recesses 164 can be defined in the connection base 22.

Figure 7A:
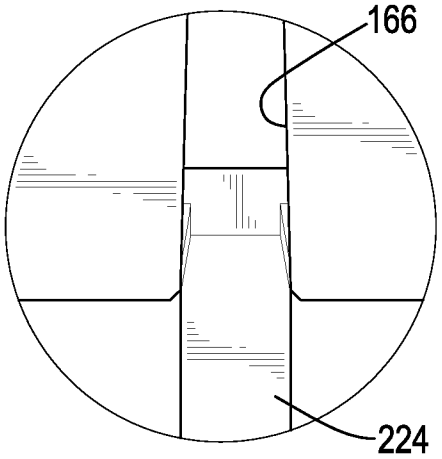
FIG. 7A is an enlarged side view of the cover and the cutter assembly in FIG. 7.
Figure 7:
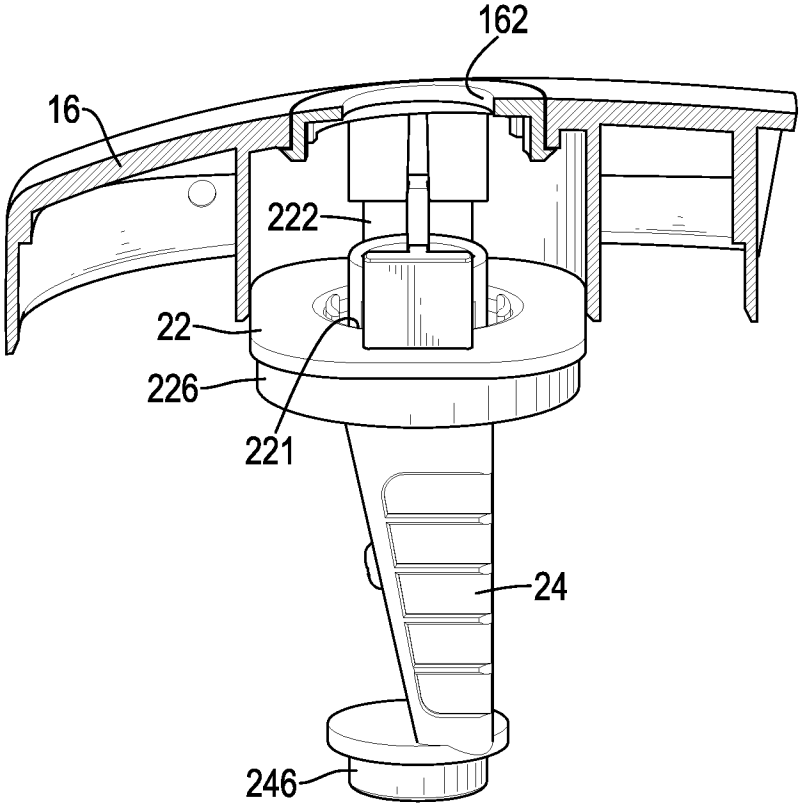
FIG. 7 is a perspective view in partial section of the cover and the cutter assembly of the pencil sharpener in FIG. 3.

With reference to FIGS. 7 and 7A, each connection tab 222 has a T-shaped cross section and has an engaging rib 224 formed on the connection tab 222. Each connection recess 164 has an engaging slot 166 engaging the engaging rib 224 on the corresponding connection tab 222. The engaging slot 166 has a width smaller than the thickness of the corresponding engaging rib 224, such that the engaging slot 166 can provide a lateral engaging force to the corresponding engaging rib 224 to securely connect the connection base 22 with the cover 16.

The cutter bracket 24 is connected rotatably with the connection base 22. The connection base 22 has a combining hole 221 defined centrally through the connection base 22 and corresponding to and aligning with the pencil inserting hole 162. The cutter bracket 24 has multiple resilient arms 242 formed on an end of the cutter bracket 24 adjacent to the connection base 22 and hooking on a surface of the connection base 22 around the combining hole 221. With the engagement between the resilient arms 242 and the combining hole 221, the cutter bracket 24 is connected rotatably with the connection base 22. Alternatively, the resilient arms 242 are formed on the connection base 22 and hook around a periphery of the cutter bracket 24 to rotatably connect the cutter bracket 24 with the connection base 22.

Figure 6:
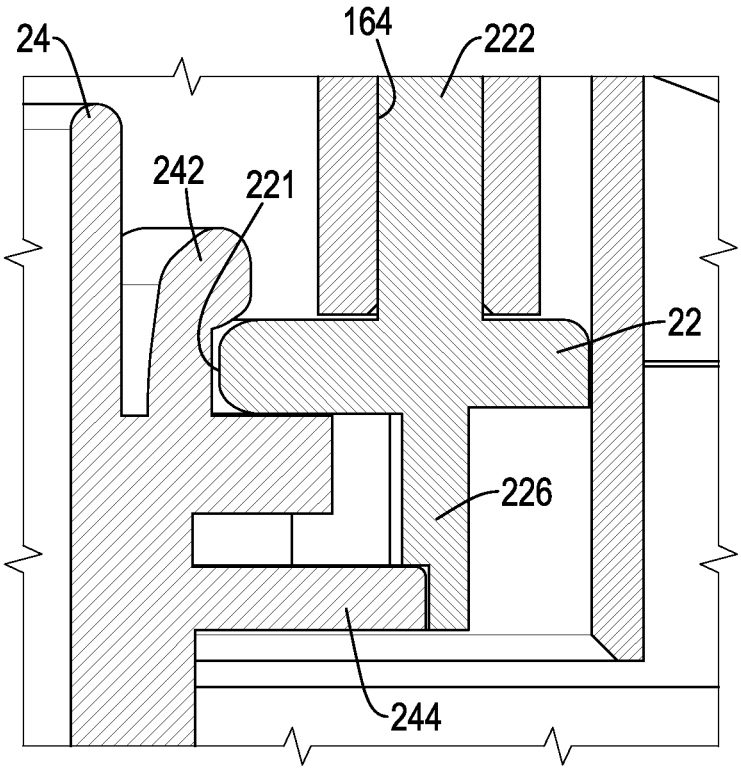
FIG. 6 is an enlarged cross sectional side view of the pencil sharpener in FIG. 5.

With reference to FIG. 6, a first gap is formed between each resilient arm 242 and an inner surface of the combining hole 221 to reduce the friction between the cutter bracket 24 and the connection base 22, such that the rotation between the cutter bracket 24 and the connection base 22 is smooth. In addition, the connection base 22 has an annular skirt 226 formed around the connection base 22 at a side facing the cutter bracket 24. The cutter bracket 24 has a bracket disk 244 formed around and protruding radially from the cutter bracket 24 near the end of the cutter bracket 24 that is adjacent to the connection base 22. The bracket disk 244 is mounted in the annular skirt 226 on the connection base 22, and a second gap is formed between the bracket disk 244 and the inner surface of the annular skirt 226. Preferably, the width of the second gap between the bracket disk 244 and the annular skirt 226 is smaller than that of the first gap between the resilient arms 242 and the inner surface of the combining hole 221. Accordingly, the friction occurring during the rotation of the cutter bracket 24 can be reduced, and the rotation of the cutter bracket 24 is smooth and the cutter bracket 24 is kept from swinging. In addition, when the resilient arms 242 are formed on the connection base 22, the resilient arms 242 are formed on the annular skirt 226 of the connection base 22 and hook around the bracket disk 244 so as to rotatably connect the cutter bracket 24 with the connection base 22. Furthermore, a ratchet device is mounted between the connection base 22 and the cutter bracket 24 to enable the cutter bracket 24 to rotate relative to the connection base 22 in a unidirectional rotation.

The cutter 26 is mounted on the cutter bracket 24, may be a blade, a cylindrical hobbing cutter or a planning cutter and is not limited in the present invention. In addition, the cutter bracket 24 further has a connection element 246 formed on the cutter bracket 24 at an end opposite to the connection base 22 and connected with the transmission element 122 of the transmission device 12. Preferably, the connection element 246 may be a sleeve provided with multiple teeth formed on an inner surface of the sleeve. The teeth of the sleeve engage the transmission element 122 of the transmission device 12, such that the cutter bracket 24 can be driven by the transmission device 12 to rotate relative to the connection base 22. Consequently, a pencil can be sharpened by the cutter 26 on the rotating cutter bracket 24. Additionally, the connection element 246 may be an inner gear or a spur gear to fit with the transmission devices 12 of different types.

Figure 2:
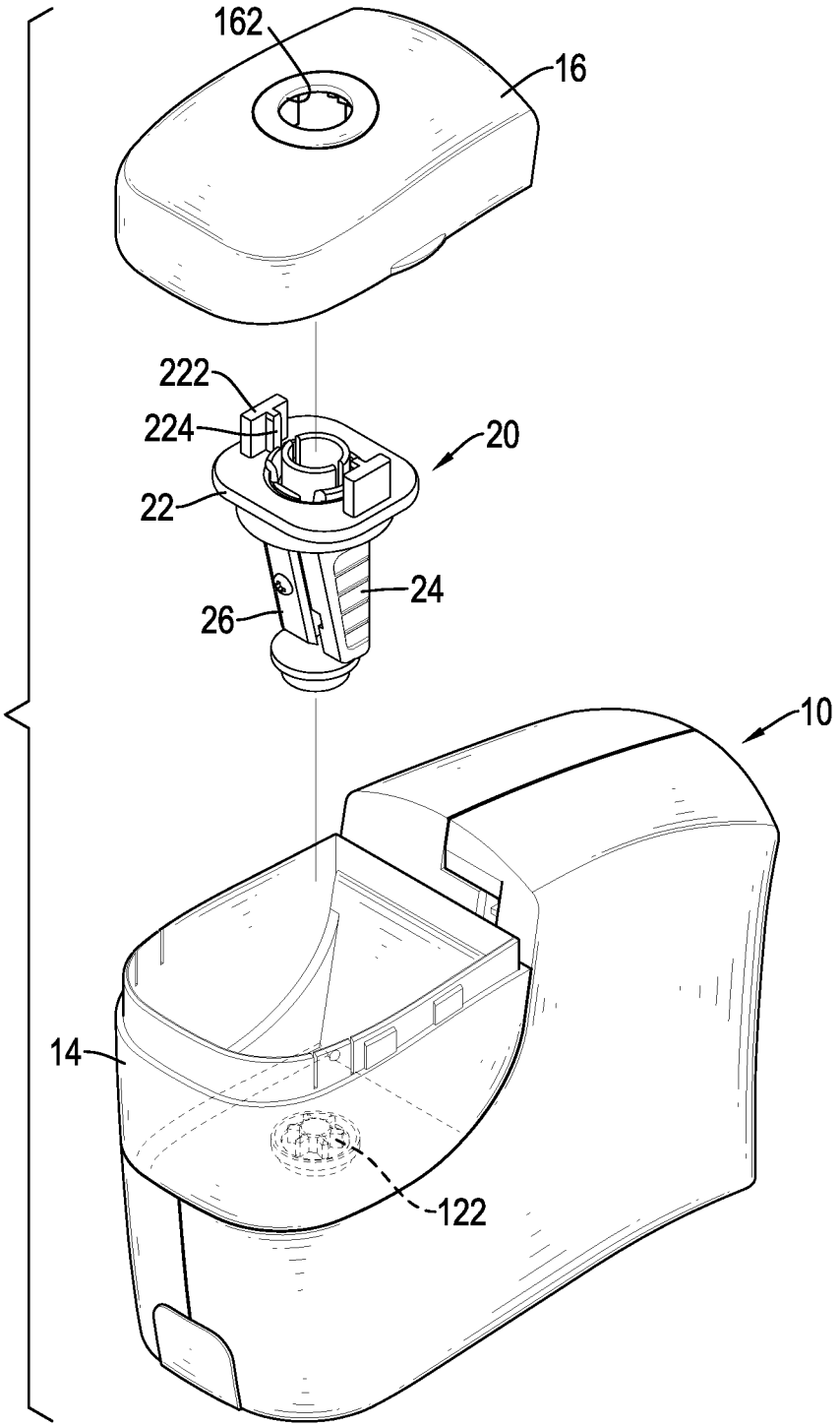
FIG. 2 is a partially exploded perspective view of the pencil sharpener in FIG. 1.
Figure 3:
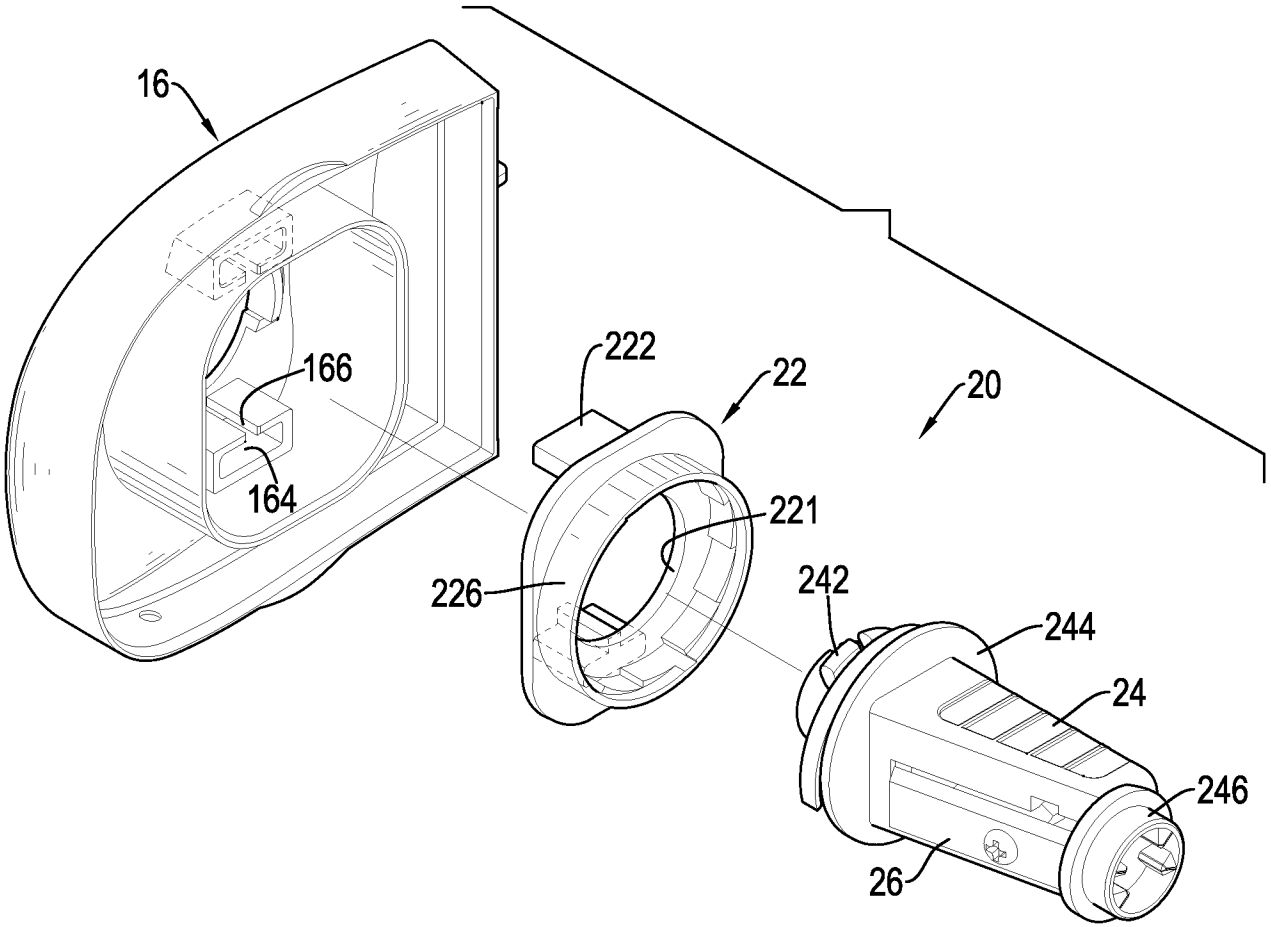
FIG. 3 is an enlarged exploded perspective view of the cover and the cutter assembly of the pencil sharpener in FIG. 1.
Figure 4:
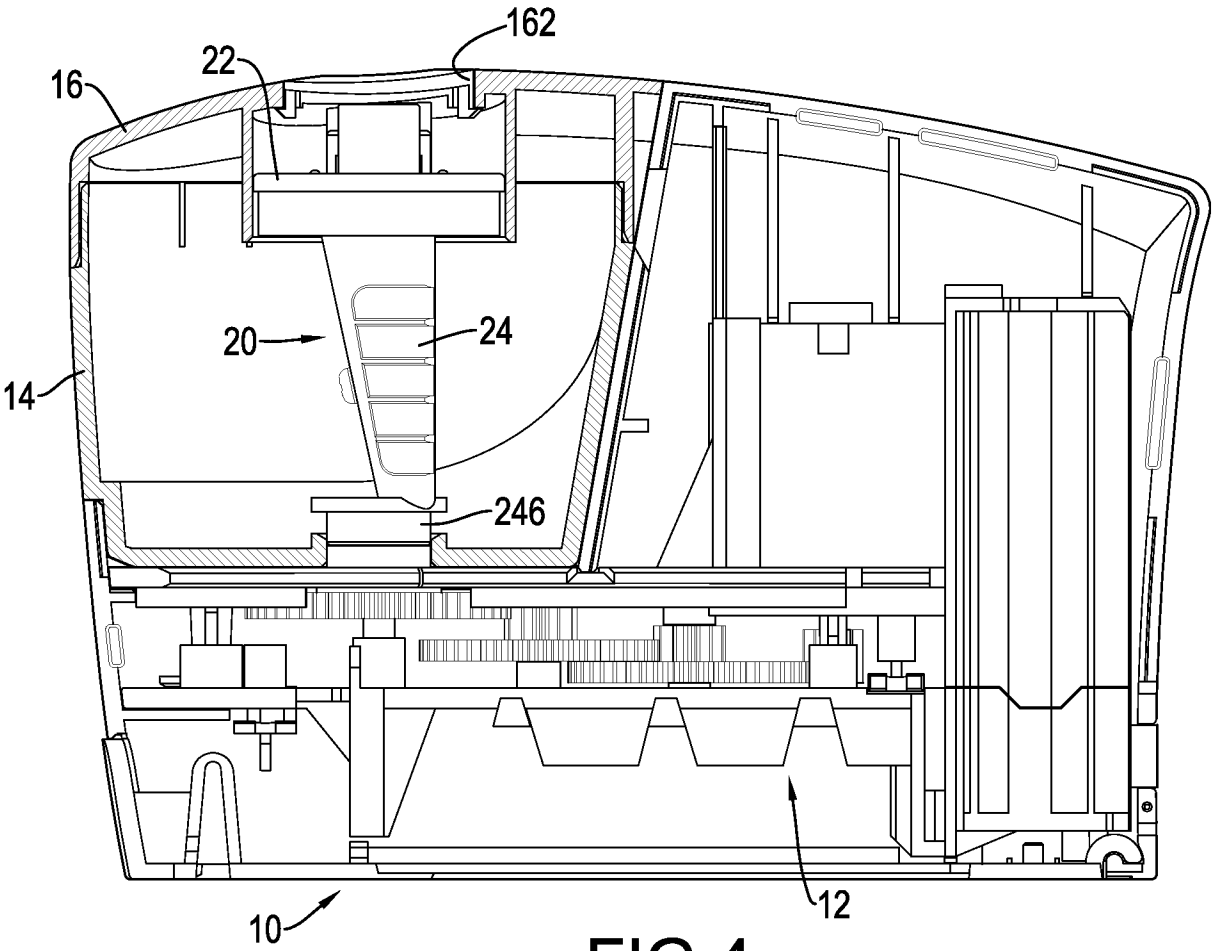
FIG. 4 is a side view in partial section of the pencil sharpener in FIG. 1.
Figure 5:
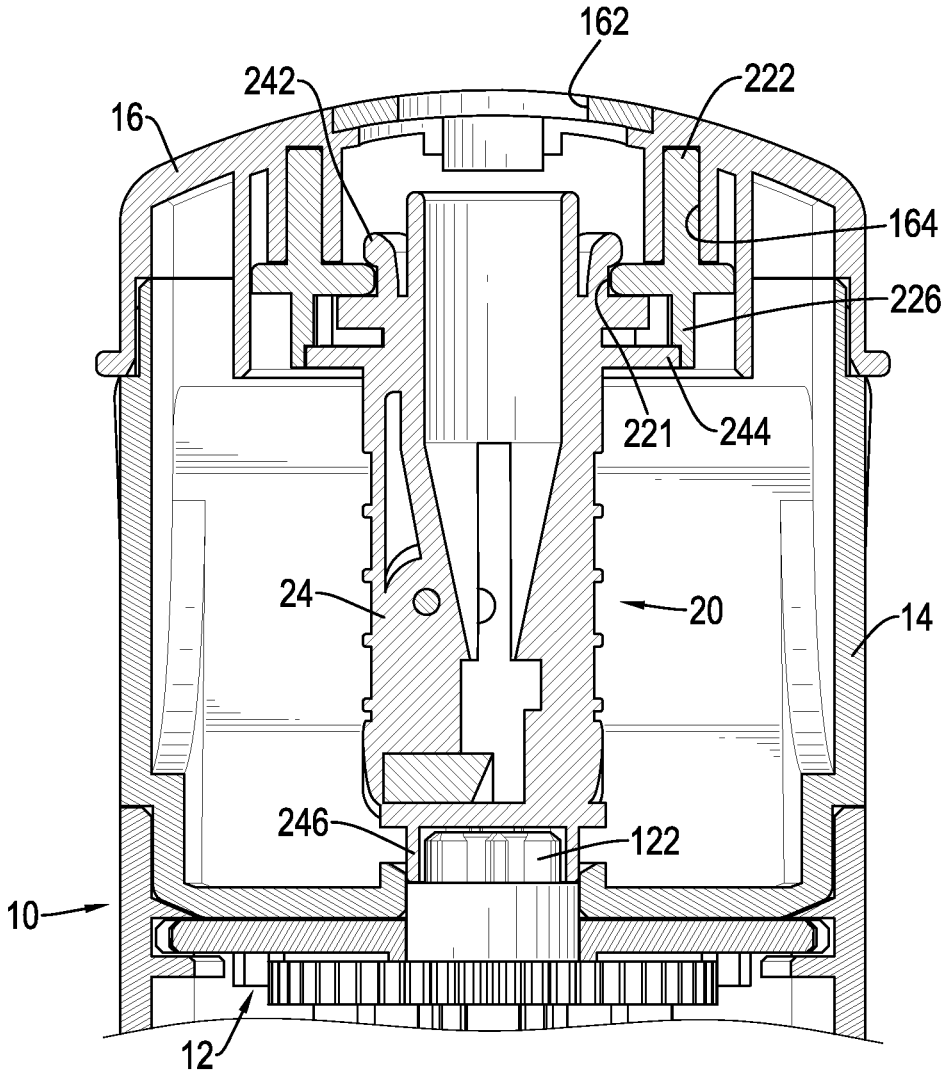
FIG. 5 is an enlarged end view in partial section of the pencil sharpener in FIG. 1.

With reference to FIGS. 2 and 3, when the cutter 26 is worn off or damaged, the cover 16 is removed from the waste case 14 and the cutter assembly 20 that is connected to the cover 16 is also detached from the waste case 14. Because the cutter assembly 20 is connected with the cover 16 by the engagement of the connection tabs 222 and the connection recesses 164, the cutter assembly 20 can be easily detached from the cover 16. Another cutter assembly 20 having a new cutter 26 can also be easily connected with the cover 16 by the engagement of the connection tabs 222 and the connection recesses 164. By reattaching the cover 16 onto the waste case 14, the process of replacing the cutter assembly 20 is finished.

Furthermore, because the waste case 14 can be mounted detachably on the body 10, the waste case 14 can be detached from the body 10. Consequently, the waste case 14 with the cover 16 and the cutter assembly 20 can be implemented as a manual pencil sharpener to sharpen a pencil manually. Therefore, the electric pencil sharpener can be adapted to be electrical and manual in operation and is versatile in use.

Figure 8:
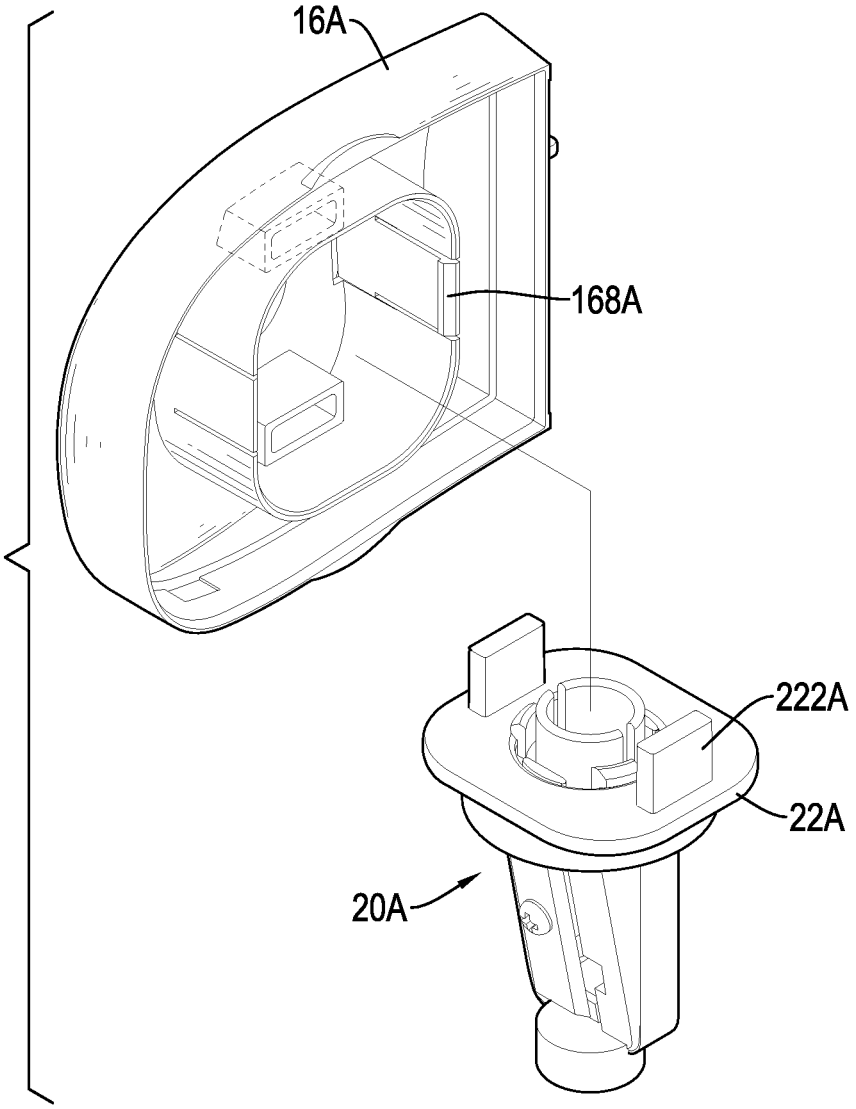
FIG. 8 is an exploded perspective view of a second embodiment of a cover and a cutter assembly of a pencil sharpener in accordance with the present invention.

With reference to FIG. 8, in the second embodiment of the electric pencil sharpener in accordance with the present invention, each connection tab 222A on the connection base 22A of the cutter assembly 20A is a flat board without an engaging rib 224 as shown in FIG. 2. The cover 16A further has multiple connection hooks 168A formed on the bottom of the cover 16A and hooking around the periphery of the connection base 22A. Accordingly, detaching the cover 16A from the waste case simultaneously detaches the cutter assembly 20A from the waste case as well.

Figure 9:
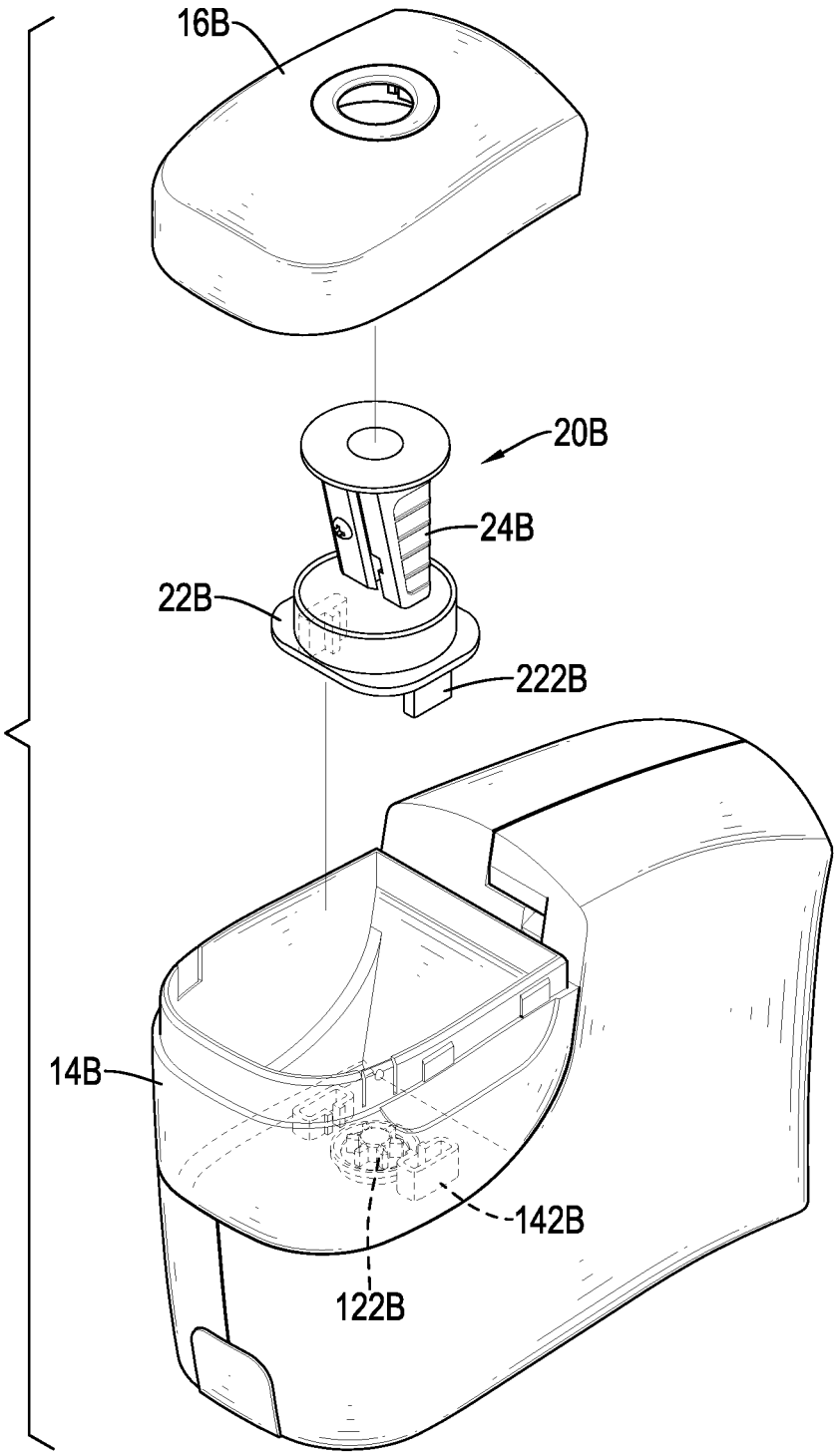
FIG. 9 is an exploded perspective view of a third embodiment of a pencil sharpener in accordance with the present invention.
Figure 10:
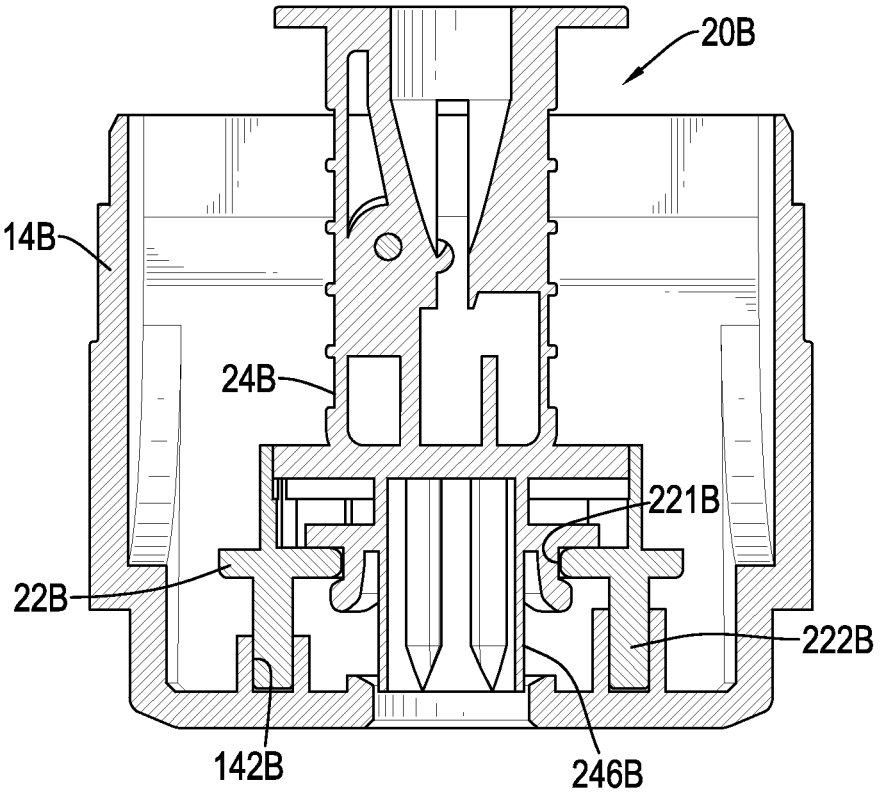
FIG. 10 is an enlarged cross sectional side view of the pencil sharpener in FIG. 9.
Figure 11:
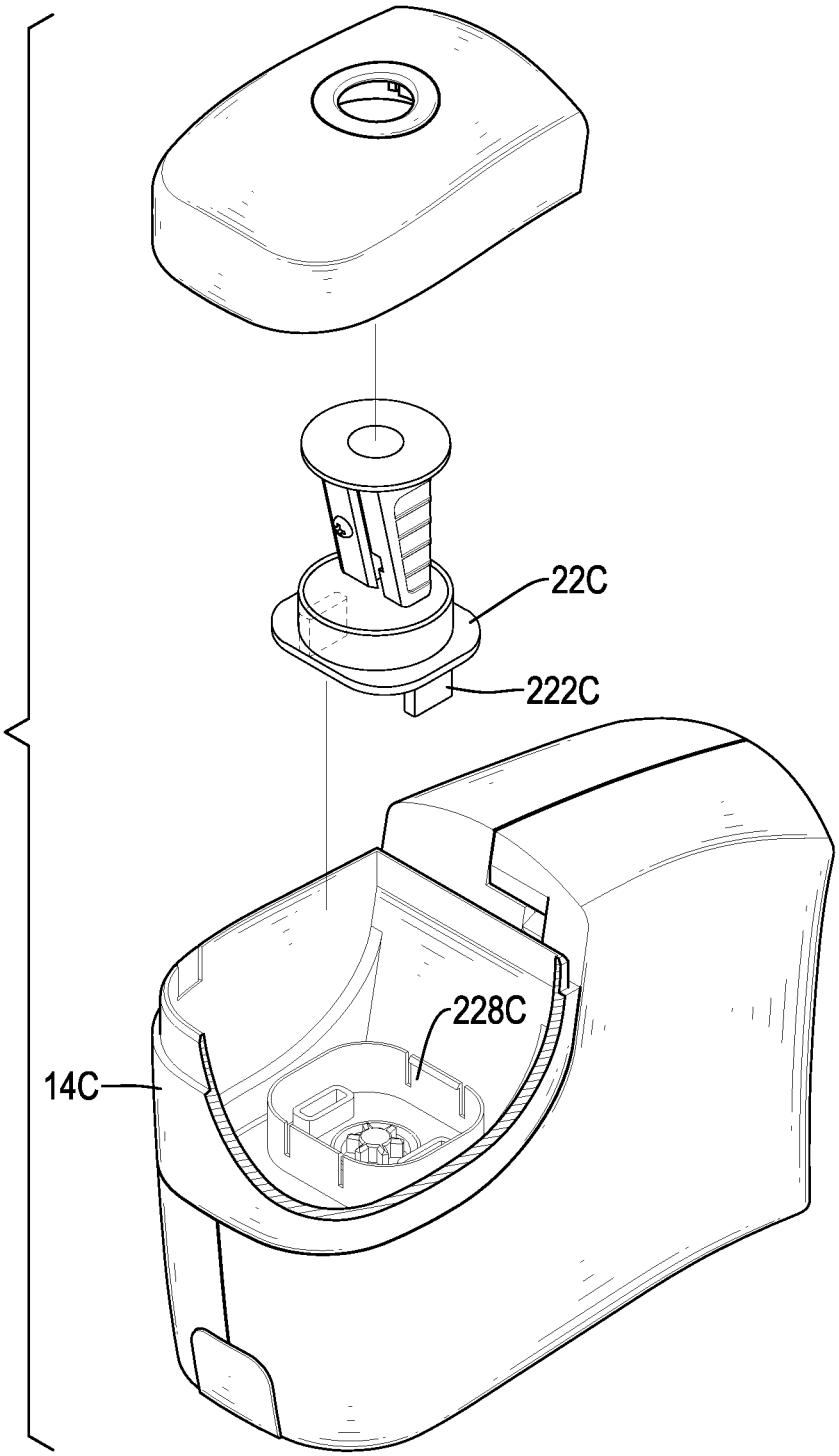
FIG. 11 is an exploded perspective view in partial section of a fourth embodiment of a pencil sharpener in accordance with the present invention.

With reference to FIGS. 9 and 10, in the third embodiment of an electric pencil sharpener in accordance with the present invention, the connection base 22B of the cutter assembly 20B is connected detachably with the bottom of the waste case 14B with a male and female connection structure. Preferably, the connection base 22B comprises at least one connection tab 222B, and at least one connection recess 142B is defined in the bottom of the waste case 14B and respectively engages the at least one connection tab 222B on the connection base 22B. With the engagement between the connection tabs 222B and the connection recesses 142B, the connection base 22B is connected detachably with the bottom of the waste case 14B. Alternatively, the connection tabs 222B can be formed on the bottom of the waste case 14B, and the connection recesses 142B can be defined in the connection base 22B. In addition, the connection tabs 222B can be implemented as the connection tabs 222 in the first embodiment having a T-shaped cross section. Alternatively, the connection tabs 222C can be implemented as that in the second embodiment formed as a flat board as shown in FIG. 11. Furthermore, multiple connection hooks 228C may be formed on the bottom of the waste case 14C and hooking around the periphery of the connection base 22C to enhance the combination strength and stability between the connection base 22C and the waste case 14C.

In the third embodiment, with reference to FIGS. 9 and 10, the connection element 246B on the cutter bracket 24B connected with the transmission element 122B is formed on the cutter bracket 24B at an end that is connected with the connection base 22B. The connection element 246B is mounted through the combining hole 221B and is connected with the transmission element 122B. The connection structure between the cutter bracket 24B and the connection base 22B and the engagement between the connection tabs 222B and the connection recess 142B in the third embodiment may be the same as those in the first embodiment and detail description thereof is omitted.

With such an arrangement, when the cover 16B is detached from the waste case 14B, the cutter assembly 20B can be detached from the connection recesses 142B in the bottom of the waste case 142B directly and taken out of the waste case 14B. Accordingly, a new cutter assembly 20B can be assembled into the waste case 14B conveniently.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electric pencil sharpener comprising:

a body having:

a transmission device mounted in the body; and a waste case mounted on the body and having an opening defined in a top of the waste case;

a cover mounted on and closing the opening of the waste case and having a pencil inserting hole defined through the cover; and at least one connection recess defined in the cover;

a cutter assembly mounted in the waste case, being detachable from the waste case via the opening and having:

a connection base connected detachably with the cover with a mail and female connection structure and having a combining hole defined through the connection base and corresponding to the pencil inserting hole; and at least one connection tab formed on and protruding from the connection base, and the at least one connection recess respectively engaging the at least one connection tab on the connection base;

a cutter bracket connected rotatably with the connection base and having a connection element disposed on the cutter bracket at an end opposite to the connection base and connected with the transmission device to make the cutter bracket driven by and rotate with the transmission device; and a cutter mounted on the cutter bracket.

2. The electric pencil sharpener as claimed in claim 1, wherein the cutter bracket has multiple resilient arms formed on an end of the cutter bracket adjacent to the connection base and hooking on a surface of the connection base around the combining hole.

3. The electric pencil sharpener as claimed in claim 2, wherein the connection base has an annular skirt formed around the connection base at a side facing the cutter bracket; and the cutter bracket has a bracket disk formed around and protruding radially from the cutter bracket near the end of the cutter bracket that is adjacent to the connection base, and the bracket disk is mounted in the annular skirt on the connection base.

4. The electric pencil sharpener as claimed in claim 3, wherein a first gap is formed between each resilient arm and an inner surface of the combining hole;

a second gap is formed between the bracket disk and an inner surface of the annular skirt and has a width smaller than that of the first gap.

5. The electric pencil sharpener as claimed in claim 4, wherein each one of the at least one connection tab has a T-shaped cross section and has an engaging rib formed on the connection tab; and each one of the at least one connection recess has an engaging slot engaging the engaging rib on a corresponding connection tab and having a width smaller than a thickness of the corresponding engaging rib.

6. The electric pencil sharpener as claimed in claim 4, wherein each one of the at least one connection tab is a flat board.

7. The electric pencil sharpener as claimed in claim 6, wherein the cover further has multiple connection hooks formed on a bottom of the cover and hooking around a periphery of the connection base.

8. The electric pencil sharpener as claimed in claim 1, wherein each one of the at least one connection tab has a T-shaped cross section and has an engaging rib formed on the connection tab; and each one of the at least one connection recess has an engaging slot engaging the engaging rib on a corresponding connection tab and having a width smaller than a thickness of the corresponding engaging rib.

9. The electric pencil sharpener as claimed in claim 1, wherein each one of the at least one connection tab is a flat board.

10. The electric pencil sharpener as claimed in claim 9, wherein the cover further has multiple connection hooks formed on a bottom of the cover and hooking around a periphery of the connection base.

11. The electric pencil sharpener as claimed in claim 10, wherein the connection element is a sleeve having multiple teeth formed on an inner surface of the sleeve and engaging the transmission device.

12. The electric pencil sharpener as claimed in claim 11, wherein a ratchet device is mounted between the connection base and the cutter bracket to enable the cutter bracket to rotate relative to the connection base in a unidirectional rotation.

13. The electric pencil sharpener as claimed in claim 12, wherein the waste case is mounted detachably on the body.

14. The electric pencil sharpener as claimed in claim 1, wherein a ratchet device is mounted between the connection base and the cutter bracket to enable the cutter bracket to rotate relative to the connection base in a unidirectional rotation.

15. The electric pencil sharpener as claimed in claim 1, wherein the waste case is mounted detachably on the body.

16. The electric pencil sharpener as claimed in claim 1, wherein the connection element is a sleeve having multiple teeth formed on an inner surface of the sleeve and engaging the transmission device.

* * * * *